US007280668B2

(12) United States Patent
Devantier et al.

(10) Patent No.: US 7,280,668 B2
(45) Date of Patent: Oct. 9, 2007

(54) CERAMIC METAL MATRIX DIAPHRAGM FOR LOUDSPEAKERS

(75) Inventors: Allan O. Devantier, Canyon Country, CA (US); An D. Nguyen, West Hills, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 10/041,551

(22) Filed: Jan. 7, 2002

(65) Prior Publication Data

US 2002/0141610 A1 Oct. 3, 2002

Related U.S. Application Data

(63) Continuation of application No. 09/483,291, filed on Jan. 14, 2000, now Pat. No. 6,404,897, which is a continuation-in-part of application No. 09/226,087, filed on Jan. 5, 1999, now Pat. No. 6,327,372.

(51) Int. Cl.

| | |
|---|---|
| ***H04R 1/00*** | (2006.01) |
| ***H04R 9/06*** | (2006.01) |
| ***H04R 11/02*** | (2006.01) |

(52) U.S. Cl. ..... 381/427; 381/426; 381/428; 181/167; 181/168; 181/174

(58) Field of Classification Search ..... 375/240.01–240.29; 341/67; 308/402; 381/374–375, 381/379, 361, 365, 330, 378, 386, 390, 398, 381/423–424, 427–428; 181/174, 199, 129, 181/167–172; *H04B 1/66*

See application file for complete search history.

(56) References Cited

U.S. PATENT DOCUMENTS 3,366,748 A * 1/1968 Ashworth ..... 181/144

(Continued)

OTHER PUBLICATIONS

"Aluminum Electronic Enclosures" and "Ceramic Components"; *designfax*; Circle Designfax Cards Nos. 134 and 135; Apr. 1993.

(Continued)

*Primary Examiner*—Curtis Kuntz
*Assistant Examiner*—P L Dabney
(74) *Attorney, Agent, or Firm*—Brinks Hofer Gilson & Lione

(57) ABSTRACT

This invention provides a method of manufacturing speaker diaphragm for a loudspeaker that has a composite material formed of two layers of ceramic material separated by a light metal substrate and where the core is formed by stamping a sheet of standard gauge aluminum to form a speaker core and then deep anodizing the core to obtain a ceramic layer of alumina on each surface ($Al_2O_3$) that is at least about 1 mil. thick. The invention further provides for a loudspeaker diaphragm, where the diaphragm is a composite material formed of at least two layers of ceramic material having a metal substrate therebetween and where the thickness of the metal substrate is no more than 86% of the thickness of the composite material.

38 Claims, 7 Drawing Sheets

U.S. PATENT DOCUMENTS

| | | | | |
|---|---|---|---|---|
| 3,710,040 | A * | 1/1973 | Swinehart | 310/312 |
| 4,135,601 | A * | 1/1979 | Tsukagoshi et al. | 181/167 |
| 4,344,503 | A * | 8/1982 | Nakamura et al. | 181/168 |
| 4,352,961 | A * | 10/1982 | Kumada et al. | 310/321 |
| 4,410,768 | A * | 10/1983 | Nakamura et al. | 181/167 |
| 4,431,873 | A * | 2/1984 | Dunn et al. | 367/165 |
| 4,639,283 | A * | 1/1987 | Nakamura | 156/89.13 |
| 4,726,443 | A * | 2/1988 | Ugaji et al. | 181/167 |
| 4,772,513 | A * | 9/1988 | Sakamoto et al. | 428/408 |
| 5,135,582 | A * | 8/1992 | Mochizuki et al. | 148/400 |
| 6,327,372 | B1 * | 12/2001 | Devantier et al. | 181/167 |
| 6,404,897 | B1 * | 6/2002 | Devantier et al. | 381/426 |

OTHER PUBLICATIONS

"Ti-Aluminide Blades Tested in GE Engine"; *Aviation Week & Space Technology*; Nov. 29, 1993; p. 37.

"1994 Materials Selector Issue"; *Machine Design*; Dec. 1993; pp. 10-13.

"Inside Metal-Cone Speakers"; *AudioVideo International*; Nov. 1997, pp. 24, 26, 28, 30.

"Monitor Audio Studio 10"; *Hi-Fi Answers*; Mar. 1990; pp. 29-32.

* cited by examiner

CERAMIC METAL MATRIX DIAPHRAGM FOR LOUDSPEAKERS

CROSS-REFERENCE TO RELATED APPLICATIONS

This is a continuation of application Ser. No. 09/483,291 filed Jan. 14, 2000, now U.S. Pat. 6,404,897, that is a continuation-in-part of application Ser. No. 09/226,087 filed Jan. 5, 1999, now U.S. Pat. No. 6,327,372.

BACKGROUND OF THE INVENTION

1. Field of the Invention

This invention relates to loudspeakers, and in particular, to a diaphragm for a loudspeaker that significantly improves the quality of sound and the usable life of the loudspeaker.

2. Related Art

A typical loudspeaker, as shown in FIG. 1, has a cone and/or dome diaphragm that is driven by a voice coil that is immersed in a strong magnetic field. The voice coil is electrically connected to an amplifier and, when in operation, the voice coil moves back and forth in response to the electromagnetic forces on the coil caused by the current in the coil, generated by the amplifier, and the stationary magnetic field. The cone and voice coil assembly is typically suspended by a "spider" and a "surround," a flexible connector frame. This suspension system allows the cone and coil assembly to move as a finite excursion piston over a limited frequency range. Like all mechanical structures, cones and domes have natural modes or "mode peaks" commonly called "cone break-up." The frequency at which these modes occur is largely determined by the stiffness, density, and dimensions of the diaphragm, and the amplitude of these modes is largely determined by internal damping of the diaphragm material. These mode peaks are a significant source of audible coloration and, as a result, degrade the performance of the loudspeaker system.

Designers have tended to take two paths to solve the cone break-up problem. For small diaphragms such as those found in dome tweeters, aluminum and titanium are commonly used. These titanium and aluminum diaphragms typically feature a thin anodized layer to provide a specific color to the visible surface, or to protect the metal from sunlight, humidity, or moisture. In contrast, for larger diaphragms, such as those found in subwoofers, softer materials such as polymers or papers are commonly used.

When using metal diaphragms, the dome dimensions can be manipulated such that the first natural modes of the dome are above the frequency range of human hearing. FIG. 2 shows the frequency response of a typical 1" titanium dome tweeter (note the large mode peak 22 at 25 kHz). The amplitude of these modes is usually very high because metals have very little internal damping. For diaphragms larger than approximately 1", the dome modes fall into the audible range. These modes are plainly audible as coloration because of the high amplitude of the modes. FIG. 3 shows the frequency response of a typical 3" titanium dome mid-range speaker (note several large peaks 24, 26, and 28 at 11 kHz, 16 kHz, and 18 kHz). Since the modes fall into the audible range as the size of the diaphragms increase, metal diaphragms become less desirable for larger diaphragms.

For larger diaphragms, softer materials such as polymers or papers are commonly used. These materials have several natural modes in the band in which they operate. However, the internal damping of these materials is high enough so that most of these modes do not cause audible coloration. The remaining modes are either compensated for in other parts of the loudspeaker system design, resulting in increased costs, or are not addressed at all, resulting in lower performance. FIG. 4 shows the frequency response of a typical 5" woofer with a polypropylene cone (note the large mode peaks 30 and 32 at 4 kHz and 5 kHz).

As an alternative to metal, paper and polymers, ceramic materials such as alumina or magnesia may be used. These ceramic materials offer significantly higher stiffness numbers and slightly better internal losses than typical metals such as titanium or aluminum. As a result, the natural modes of diaphragms made of these materials are moved higher in frequency and reduced in amplitude and, thus, reduce audible coloration. Unfortunately, pure ceramics are very brittle and are prone to shattering when used as loudspeaker diaphragms. Additionally, making diaphragms of appropriate dimensions can be very expensive. As a result, pure ceramic loudspeaker diaphragms have not become common.

Table I shows the structural parameters for several common diaphragm materials.

TABLE I

PROPERTIES OF DIAPHRAGM MATERIALS

| Material | Young's Modulus (Stiffness) | Density | Speed of Sound | Internal Loss (damping) |
|---|---|---|---|---|
| Paper | $4 \times 10^9$ Pa | 0.4 g/cm$^3$ | 1000 m/sec | 0.06 |
| Polypropylene | $1.5 \times 10^9$ Pa | 0.9 g/cm$^3$ | 1300 m/sec | 0.08 |
| Titanium | $110 \times 10^9$ Pa | 4.5 g/cm$^3$ | 4900 m/sec | 0.0003 |
| Aluminum | $70 \times 10^9$ Pa | 2.7 g/cm$^3$ | 5100 m/sec | 0.0003 |
| Alumina | $340 \times 10^9$ Pa | 3.8 g/cm$^3$ | 9400 m/sec | 0.004 |

As yet another alternative to metal, paper or ceramic diaphragms, some designers have designed diaphragms that are made of both ceramic and metal. These diaphragms are formed by applying a skin of alumina or ceramic on each side of the aluminum core or substrate. The alumina thus supplies the strength and the aluminum substrate supplies the resistance to shattering. It has high internal frequency losses. The resulting composite material is less dense and less brittle than traditional ceramics, yet is significantly stiffer, and has better damping than titanium. It also resists moisture and sunlight better than any polymer and is at least as good as other metals for providing such resistance.

These ceramic/metal cones are typically 3 mils. thick with a 2.6 mils. thick substrate of aluminum and 0.2 mil. thick layers of alumina one on each side of the substrate. In these prior art ceramic/metal cones, the metal substrate represented approximately 87% of the total thickness of the cone. Because of the prior art methods of manufacturing the cones, the amount of ceramic that could be applied to the metal substrate was limited to a depth of about 1/10 of a mil and therefore the quality that could be achieved through this method was similarly limited. Thus, a need exists for a method of anodizing the metal substrate that will allow for a depth of more than 1/10 of a mil of ceramic on each side of the cone and thereby reduce the representative amount of metal in the cone.

SUMMARY OF THE INVENTION

This invention relates to a speaker diaphragm that is formed of a matrix, or layers, of a light metal substrate such as aluminum, positioned between two ceramic layers, preferably aluminum oxide ($Al_2,O_3$). The speaker diaphragm is first formed from the metal substrate. A layer of ceramic is then placed on each side of the metal substrate at a depth greater than 1/10 of a mil through known anodizing methods. By anodizing at depths greater than 1/10 of mil, a diaphragm with the thickness of the metal substrate less than 87% of the total thickness of the diaphragm can be formed.

The invention further provides for a loudspeaker diaphragm, where the diaphragm is a composite material formed of at least two layers of ceramic material having a metal substrate therebetween and where the thickness of the metal substrate is no more than 86% of the thickness of the composite material.

Other designs, structures, methods, features and advantages of the invention will be or will become apparent to one with skill in the art upon examination of the following figures and detailed description. It is intended that all such additional designs, structures, methods, features and advantages be included within this description, be within the scope of the invention, and be protected by the accompanying claims.

BRIEF DESCRIPTION OF THE FIGURES

The components in the figure are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENT(S)

Figure 1:
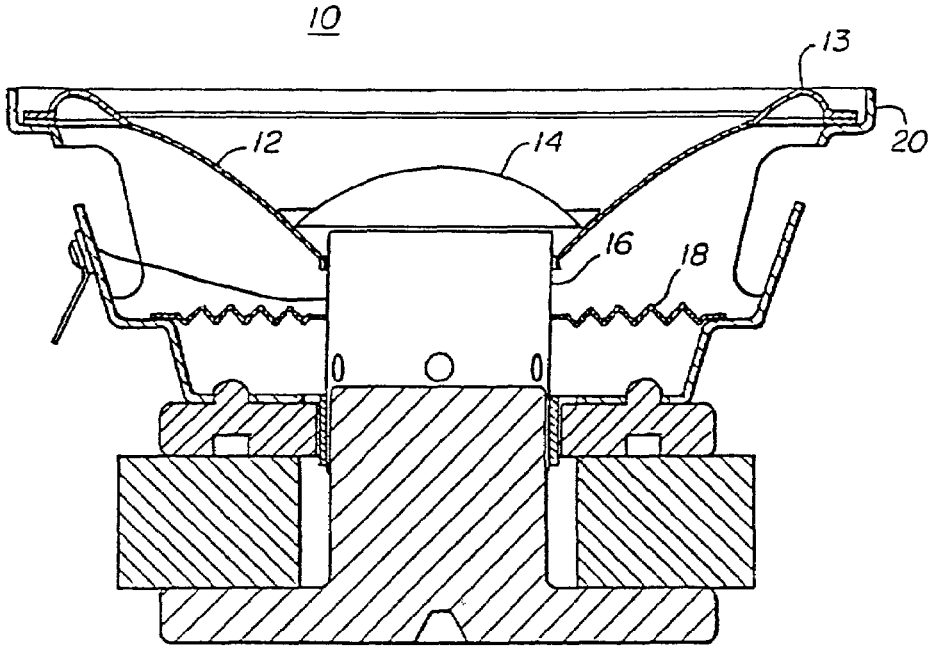
FIG. 1 is a cross-sectional view of a typical loudspeaker transducer.

FIG. 1 illustrates a typical loudspeaker 10 having a cone 12 and/or dome 14 diaphragm that is driven by a voice coil 16 that is immersed in a strong magnetic field. The voice coil 16 is electrically connected to an amplifier and, when in operation, the voice coil 16 moves back and forth in response to the electromagnetic forces on the coil caused by the current in the coil, generated by the amplifier, and the stationary magnetic field. A "spider" 18 and a "surround" 13, a flexible connector frame 20 typically suspends the cone 12 and voice coil 16 assembly.

Figure 5:
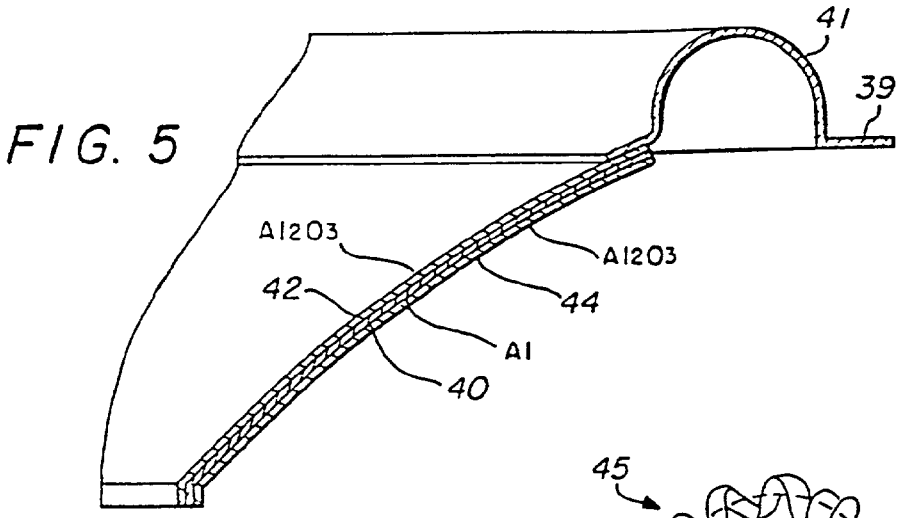
FIG. 5 is a partial cross-sectional view applied to a 4" mid-range cone.

In FIG. 5, a composite diaphragm 38 composed of a metal core, or substrate 40, with a layer of ceramic material 42 and 44 on either side in appropriate proportions, so as to minimize both cone break-up (extend the frequency range) and brittleness. The diaphragm 38 is coupled to frame 39 through flexible connector 41 and can be composed of any metal substrate and any ceramic skin. Of the common metals, aluminum has the lowest density, making it the ideal substrate. However, there is no known reason why other metals, such as copper, titanium and the like should not have the same advantages as the use of aluminum.

The diaphragm or cone 38 is first formed by using standard metal forming techniques to form the metal substrate into the desired shape of the diaphragm 38. The diaphragm 38 is then anodized in a well-known manner. The technique of forming the cone 38 prior to anodizing the metal allows for deeper anodizing techniques to be used to form the cone 38.

FIG. 5 shows the invention in partial cross section as applied to a 4" mid-range cone. In this example a cone of 3 mils. thickness is composed of a substrate of aluminum of 1 mil. thickness and two layers of alumina, each 1 mil. thick, one on each side of the core 40.

Figure 6:
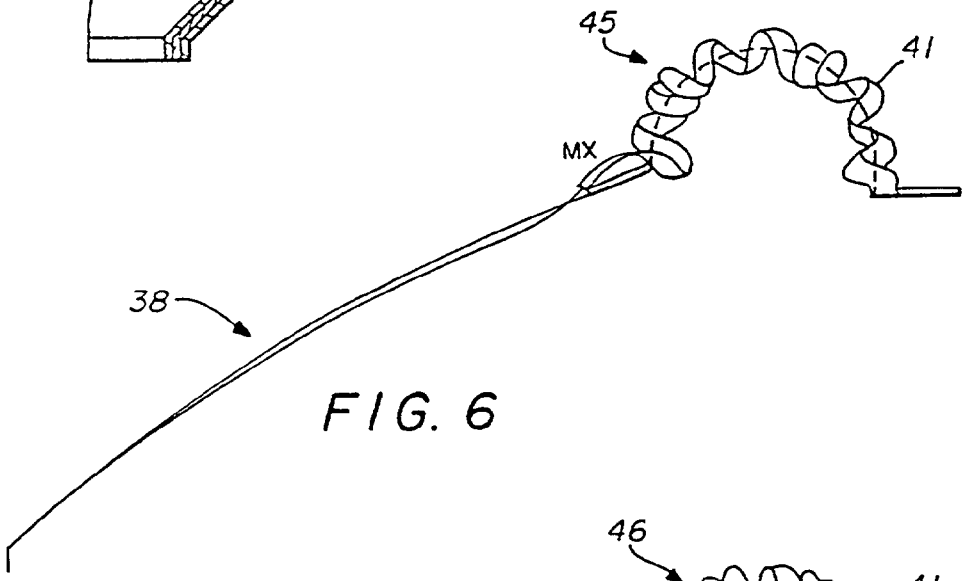
FIG. 6 illustrates the Finite Element Analysis (FEA) of a typical 4" midrange cone constructed of aluminum.
Figure 7:
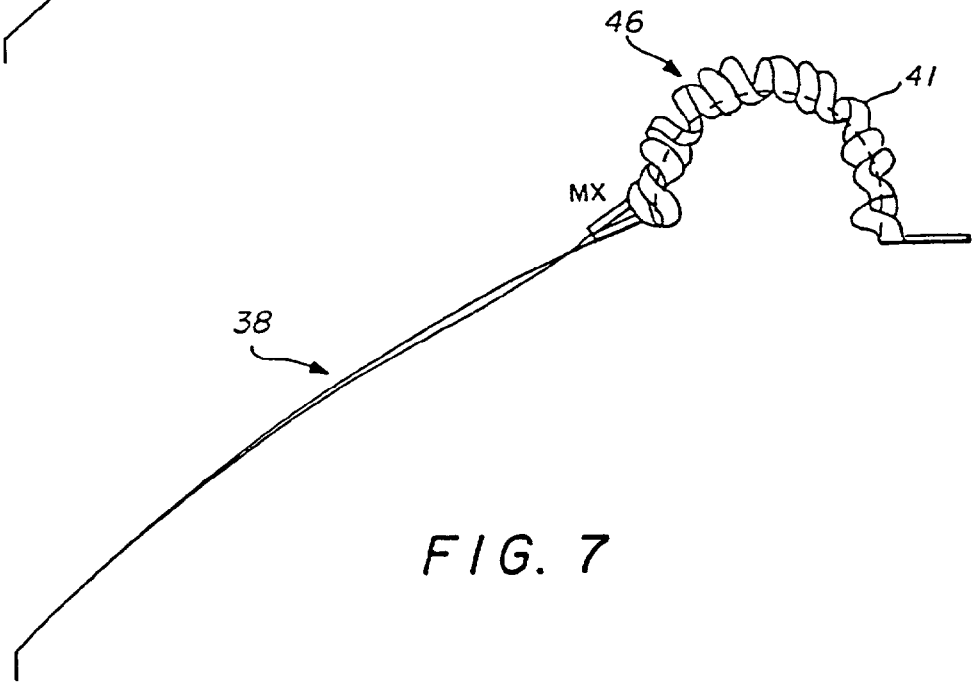
FIG. 7 shows the FEA of the cone.

FIG. 6 shows the Finite Element Analysis ("FEA") of a typical 4" mid-range cone 38 constructed solely of aluminum. The first natural mode peak 44 of the cone distorts the flexible connector 41 and occurs at 8 kHz. In contrast, FIG. 7 shows the FEA of the same cone constructed while using a 1 mil. aluminum substrate and two 1 mil. layers of alumina, one on each side. The first natural mode 46 of this cone moves all the way to 15 kHz from the 8 kHz of the cone of FIG. 6. In other words, the cone "break-up" occurs at 15 kHz as compared to cone "break-up" at 8 kHz of the same prior art speaker.

Figure 8:
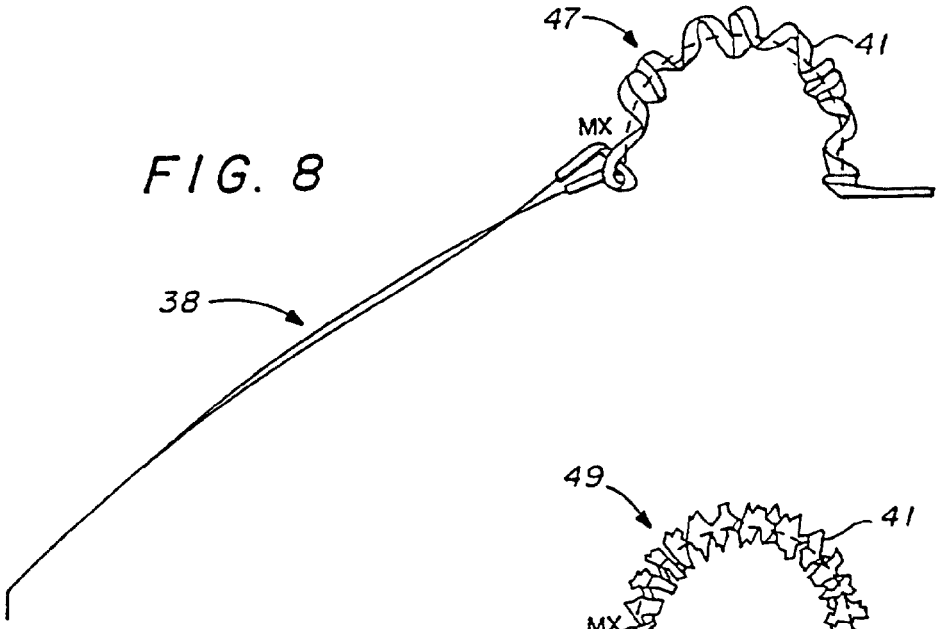
FIG. 8 shows the FEA of a cone having an aluminum substrate that represents 80% of the total cone thickness.
Figure 9:
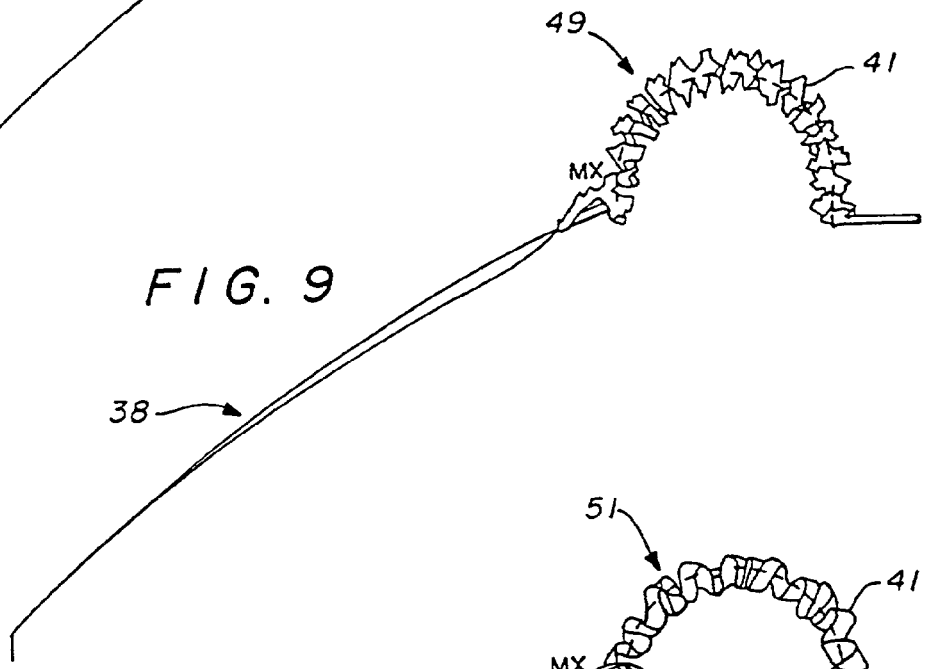
FIG. 9 shows the FEA of a cone having an aluminum substrate that represents 20% of the total cone thickness.
Figure 10:
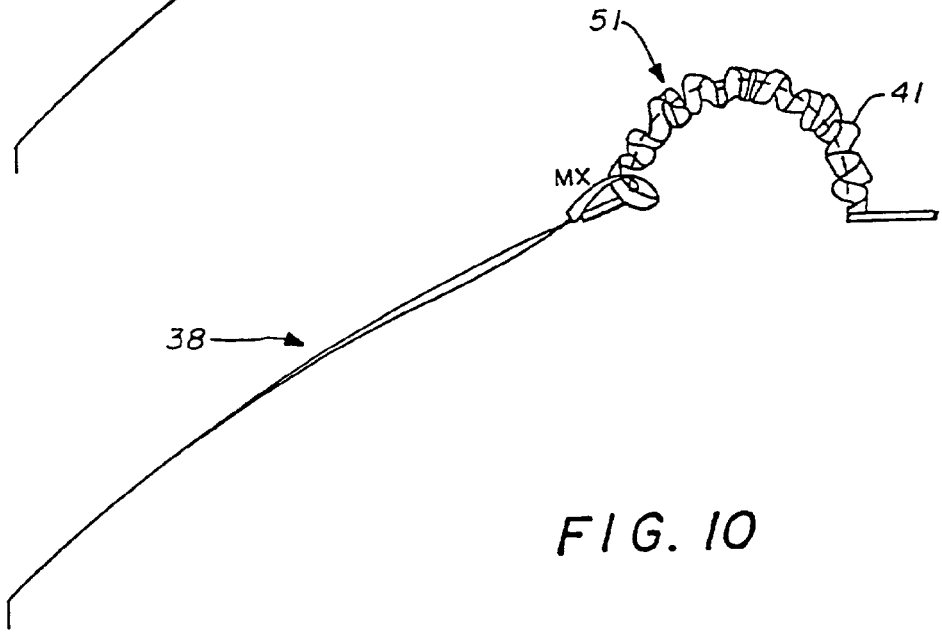
FIG. 10 shows the FEA of a cone having an aluminum substrate made of solid ceramic.

FIGS. 8 and 9 show the FEA of cones with aluminum substrates that represent 80% of the total thickness (FIG. 8) and aluminum substrates that represent 20% of the total thickness (FIG. 9), respectively. As can be seen in Table II, such cone with 80% aluminum substrate has a first "break-up" mode 47 at 12.4 kHz while a cone with 20% aluminum substrate has a first "break-up" mode at 15.95 kHz. For reference, the FEA of a solid ceramic cone is also included as FIG. 10 where the first "break-up" mode 51 occurs at 16 kHz. The optimum thickness for the aluminum substrate typically ranges from 20% to 80% of the total thickness of the diaphragm. For transducer applications, typical thickness of the diaphragm may range from 1 mil. to 25 mils. thickness. As stated, Table II shows the FEA results of various percentages of alumina to the total thickness of the cone from 100% aluminum to 100% alumina.

TABLE II

| Material Type | Frequency of the cone's first bending mode | Frequency of the cone's first significant break-up mode | Frequency of the cone's second significant break-up mode | Frequency of the cone's third significant break-up mode |
|---|---|---|---|---|
| 100% Aluminum | 6902 Hz | 8410 Hz | 11009 Hz | 12778 Hz |

TABLE II-continued

| Material Type | Frequency of the cone's first bending mode | Frequency of the cone's first significant break-up mode | Frequency of the cone's second significant break-up mode | Frequency of the cone's third significant break-up mode |
|---|---|---|---|---|
| 10% Aluminum/ 80% Aluminum/ 10% Alumina | 7840 Hz | 12400 Hz | 15060 Hz | 17340 Hz |
| 33% Alumina/ 33% Aluminum/ 33% Alumina | 9903 Hz | 15060 Hz | 17010 Hz | 19050 Hz |
| 40% Alumina/ 20% Aluminum/ 40% Alumina | 10100 Hz | 15950 Hz | 18500 Hz | Above 20000 Hz |
| 100% Alumina | 11010 Hz | 16010 Hz | 19050 Hz | Above 20000 Hz |

Figure 2:
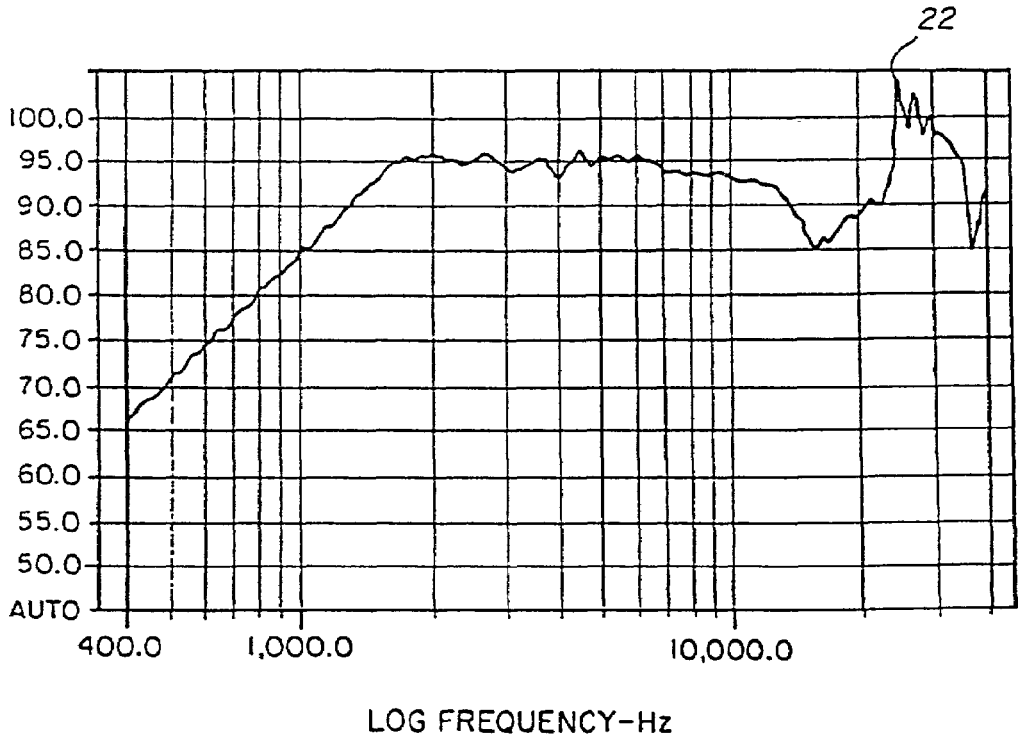
FIG. 2 illustrates the frequency response of a typical 1" titanium dome tweeter.
Figure 3:
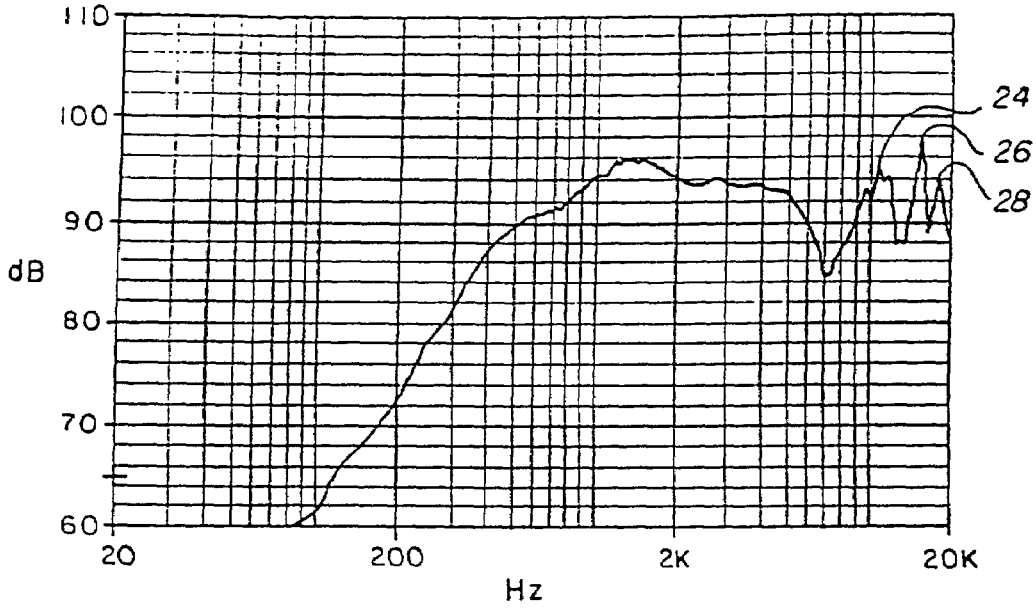
FIG. 3 illustrates the frequency response of a typical 3" titanium dome, mid-range speaker.
Figure 4:
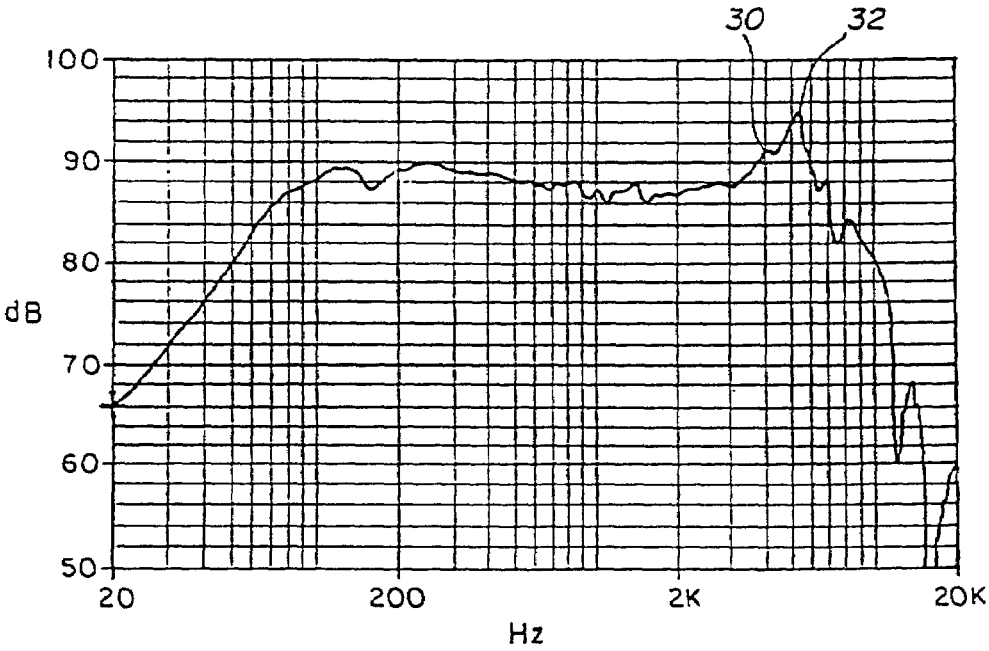
FIG. 4 illustrates the frequency response of a typical 5" woofer with a polypropylene cone.

As stated earlier, FIG. 2 shows a graph of the frequency response of a 1" dome tweeter with a traditional titanium diaphragm. The graph shows that the first resonant peak 22 occurs at 25 kHz.

Figure 11:
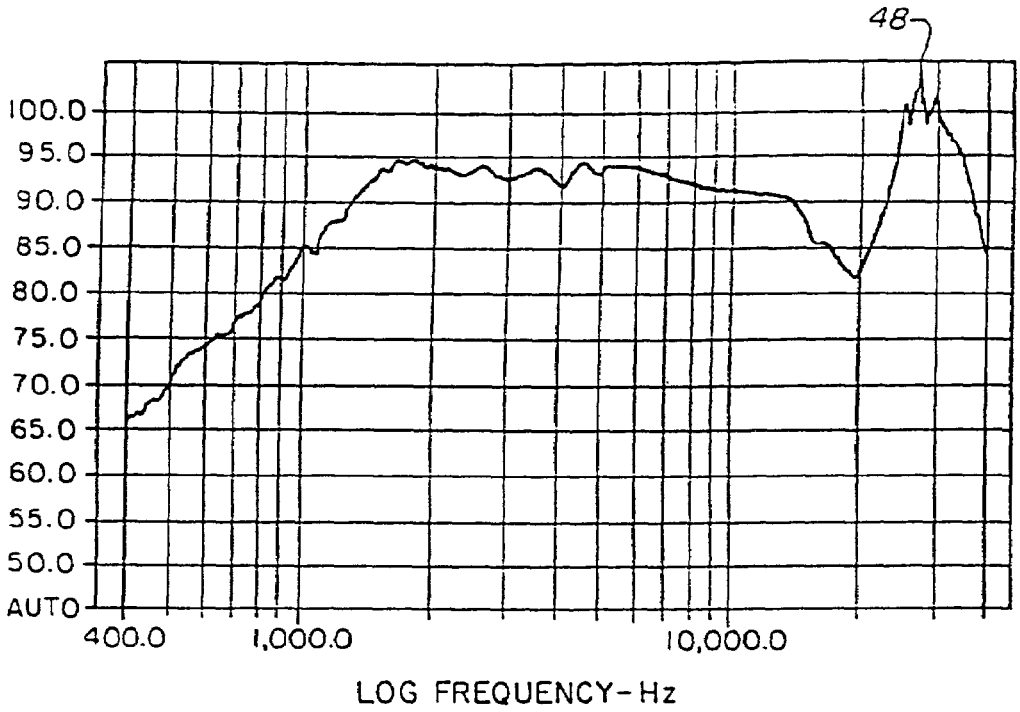
FIG. 11 shows the FEA of a 1" dome tweeter as shown in FIG. 2 except with a ceramic metal matrix dome.

FIG. 11 shows the frequency response of the same basic tweeter of FIG. 2 except with a ceramic metal matrix dome. On this tweeter the first resonant peak 48 has been moved up to 28 kHz.

Figure 12:
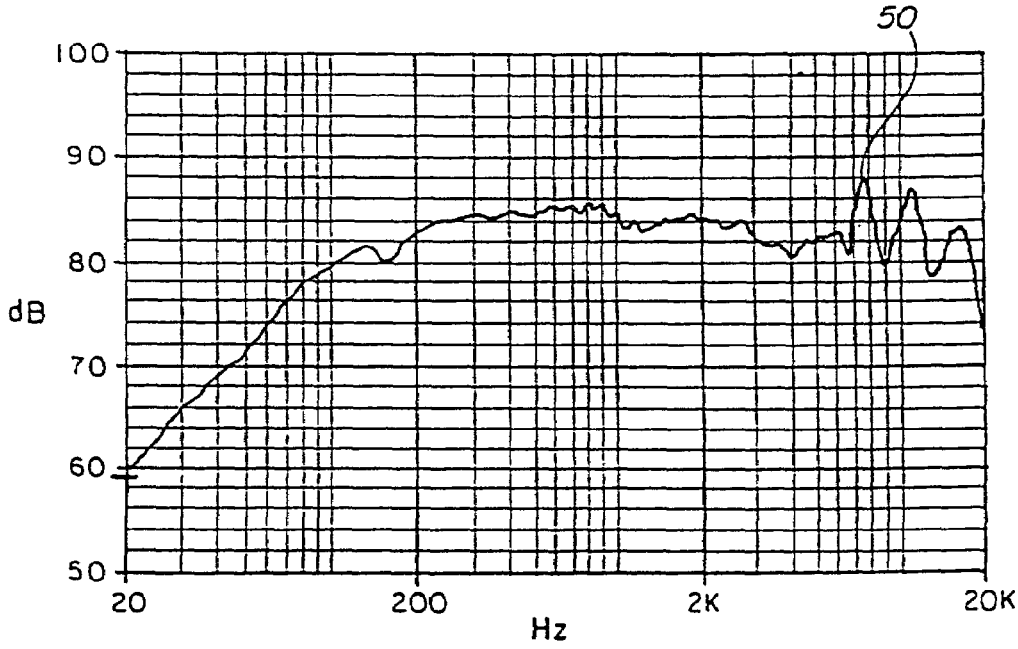
FIG. 12 shows the frequency response of a 4" mid-range speaker with a traditional aluminum cone.
Figure 13:
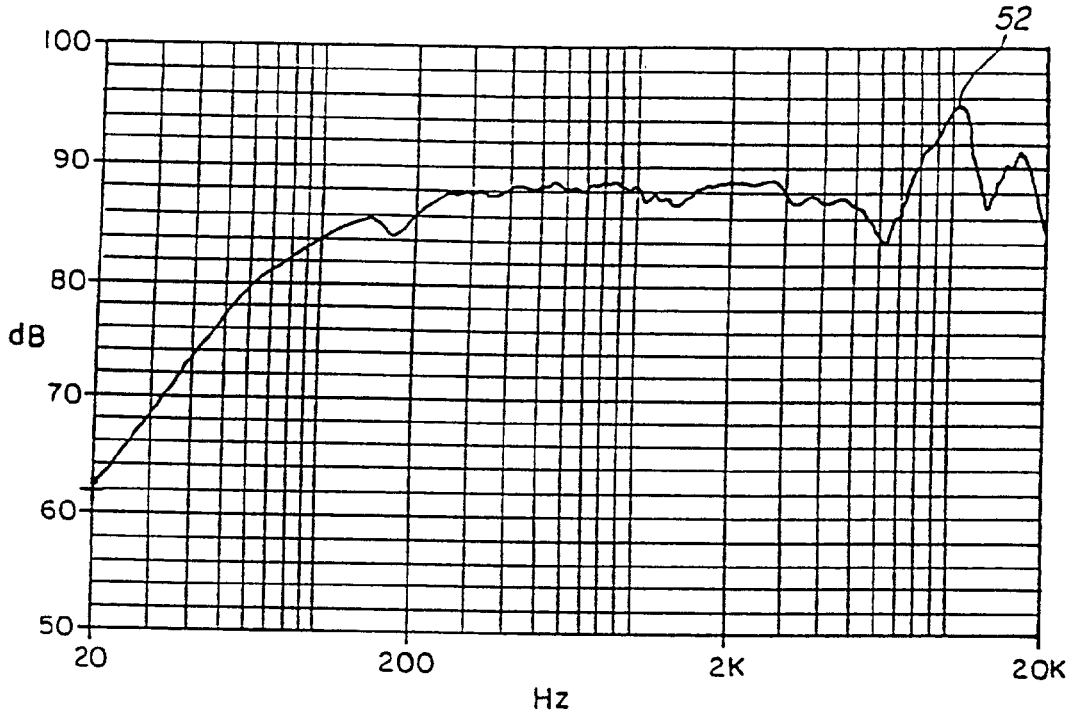
FIG. 13 shows the frequency response of the same 4" mid-range speaker in FIG. 12 with a ceramic metal matrix cone.

FIG. 12 shows the frequency response of a 4" mid-range loudspeaker with a traditional aluminum cone. The graph shows the first resonant peak 50 occurs at 8 kHz. FIG. 13 shows the frequency response of the same basic mid-range loudspeaker except with the ceramic metal matrix cone. With this midrange speaker, the first resonant peak 52 has been moved up to 11 kHz as compared to the 8 kHz frequency of the traditional aluminum cone as shown in FIG. 8.

Figure 14:
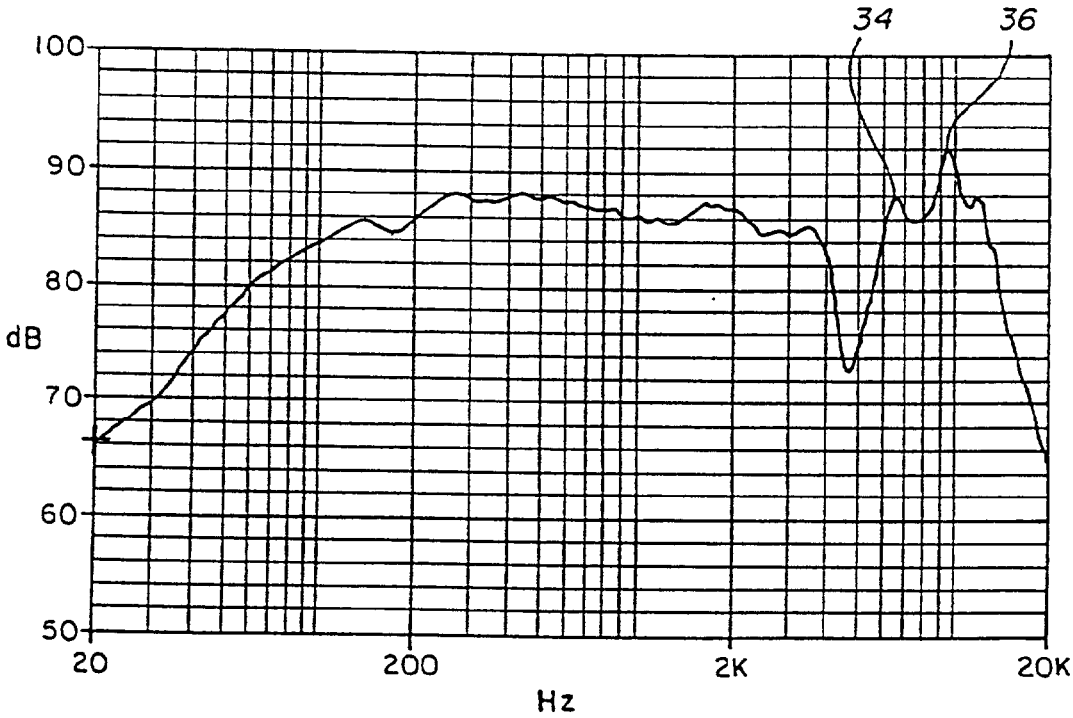
FIG. 14 shows the frequency response of the 5" woofer of FIG. 4 formed with the ceramic metal matrix cone.
Figure 15:
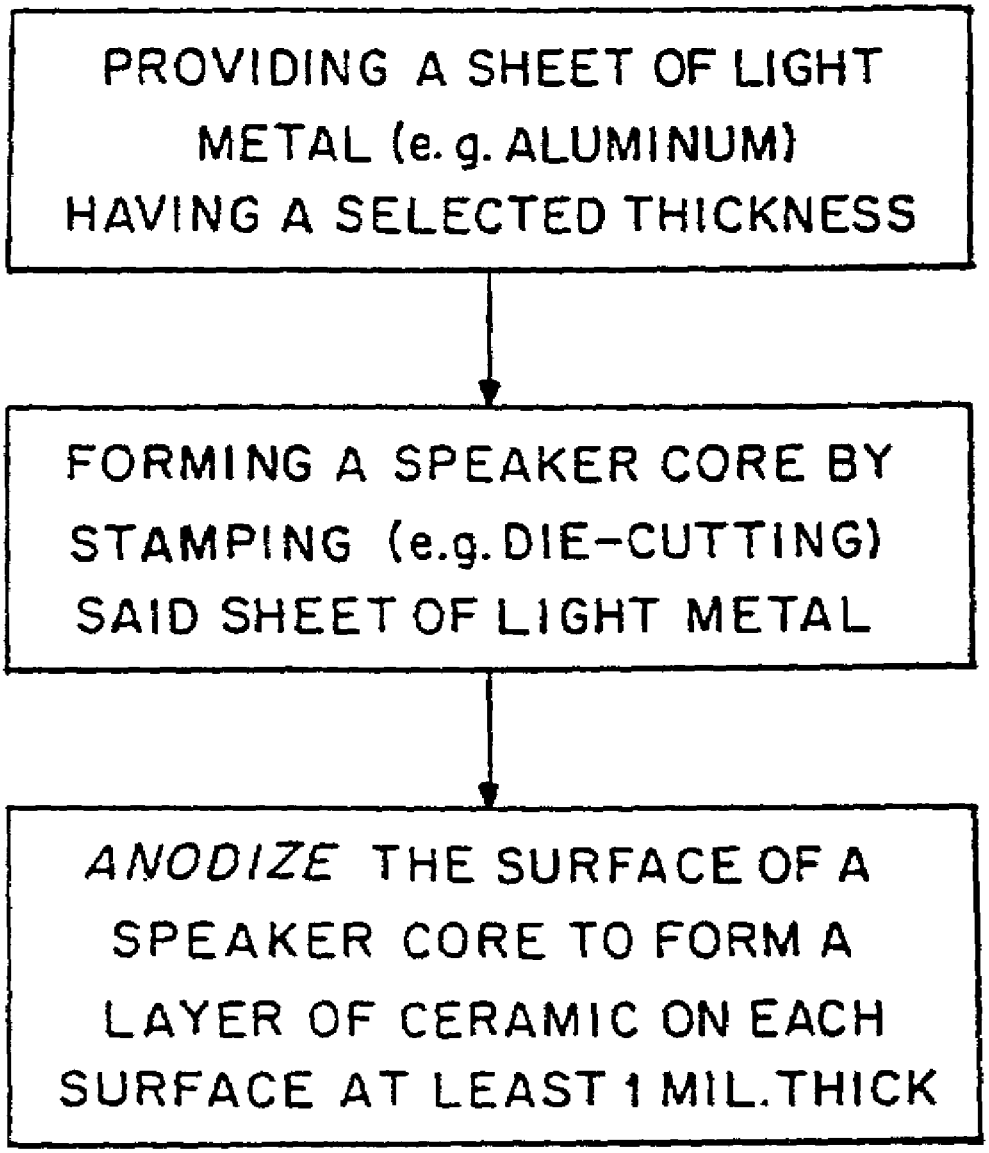
FIG. 15 is a block flow diagram of the method of forming the metal in the cone and the anodizing the metal.

The graph of FIG. 14 represents a speaker formed with the composite material has been compared earlier with the graph of FIG. 2 for the same traditional speaker.

A 4" mid-range speaker may be used as an example of how to make a ceramic metal matrix diaphragm. The basic shape of the diaphragm is shown in FIG. 5 and is formed of 2 mils. thick aluminum using standard metal forming techniques. The diaphragm is then deep anodized in a well-known manner. In the preferred example, 0.5 mil. of alumina penetrates into the aluminum and 0.5 mil. of alumina is "grown" on the surface of the aluminum on each side, again in a well-known manner. The resulting cone is approximately 3 mils. thick with a 1 mil. thick aluminum substrate and 1 mil. layer of alumina on each side.

Although ceramic/metal/ceramic speakers having a typical thickness of about 3 mils. have their best performance when the speaker is made up of 1 mil. ceramic, 1 mil. metal and 1 mil. ceramic, it has been found that an important aspect in increasing the speaker performance is that the ceramic layers be about 1 mil. or greater. Consequently, it has been disclosed that speakers with very good performance characteristics can be achieved with speakers of all sizes that have at least 1 mil. of anodizing of each surface, even though the thickness of the metal core is significantly greater than 1 mil.

As examples only, excellent results have been obtained by stamping out the shape of a tweeter speaker from standard gauge 5 mils. sheet metal such as aluminum and then deep anodizing at least ½ mil. of the metal on each surface. The resulting tweeter diaphragm formed of a composite material will then have a 1 mil. ceramic ($Al_2O_3$) layer on one surface, a 4 mil. core and a 1 mil. ceramic ($Al_2O_3$) layer on the other surface. Similarly excellent results were obtained stamping out a mid-range speaker form from standard gauge 8 mil. metal and anodized to obtain a composite speaker having a 1 mil. layer of ceramic, a 7 mil. core and a 1 mil. layer of ceramic. Excellent results were also achieved by deep anodizing 2 mils. of metal on each surface of an 8 mil. aluminum form to obtain a composite diaphragm having a 4 mil. layer of ceramic, a 4 mil. core and another 4 mil. layer of ceramic.

Using the same techniques a woofer speaker form can be stamped from standard gauge 20 mil. metal and anodized to obtain a composite speaker having a 1 mil. layer of ceramic, a 19 mil. core and a 1 mil. layer of ceramic. In the past, the anodizing depth was limited to about 1/10 of a mil. By using the thicker standard gauge metal and deep anodizing to at least 1 mil., loudspeaker quality may be improved while lowering manufacturing costs.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A speaker cone diaphragm, comprising a composite material of a predetermined thickness, where the composite material is formed of a metal substrate at least 1 mil thick between at least two layers of ceramic material at least 1 mil thick, and where the thickness of the metal substrate is no more than 86% of the thickness of the composite material, and where the ceramic material is alumina.

2. The speaker diaphragm cone of claim 1, where the metal substrate is aluminum.

3. The speaker diaphragm cone of claim 1, where the metal substrate and each layer of the ceramic material are of substantially the same thickness.

4. A speaker diaphragm cone, comprising a composite material of a predetermined thickness, where the composite material is formed of a metal substrate at least 1 mil thick between at least two layers of ceramic material at least 1 mil thick, and where the combined thickness of the ceramic material is at least 14% of the thickness of the composite material, and where the ceramic material is alumina.

5. The speaker diaphragm cone of claim 4, where the metal substrate is aluminum.

6. The speaker diaphragm cone, of claim 4 where the metal substrate and each layer of the ceramic material are of approximately the same thickness.

7. A speaker diaphragm cone, comprising a composite material of a predetermined thickness, where the composite material is formed of a metal substrate at least 1 mil thick between at least two layers of ceramic material at least 1 mil thick, and where the thickness of the metal substrate is no more than 80% of the thickness of the composite material, and where the ceramic material is alumina.

8. The speaker diaphragm cone of claim 7, where the metal substrate is aluminum.

9. The speaker diaphragm cone of claim 7, where the metal substrate and each layer of the ceramic material are of substantially the same thickness.

10. A speaker diaphragm cone, comprising a composite material of a predetermine thickness, where the composite material is formed of a metal substrate at least 1 mil thick between at least two layers of ceramic at least 1 mil thick, and where the combined thickness of the ceramic material is at least 20% of the thickness of the composite material, and where the ceramic material is alumina.

11. The speaker diaphragm cone of claim 10, where the metal substrate is aluminum.

12. The speaker diaphragm cone, of claim 10, where the metal substrate and each layer of the ceramic material are of approximately the same thickness.

13. A speaker diaphragm cone comprising:

a first ceramic layer of predetermined thickness of at least 1 mil;

a second ceramic layer of a predetermined thickness of at least 1 mil; and a metal substrate at least 1 mil thick positioned between the first and second ceramic layers, the metal substrate having a thickness that is not more than 86% of the total thickness of the first ceramic layer, the second ceramic layer and the metal substrate, and where the ceramic material is alumina.

14. The speaker diaphragm cone of claim 13, where the metal substrate is aluminum.

15. The speaker diaphragm cone of claim 13, where the metal substrate and each layer of the ceramic material are of substantially the same thickness.

16. A method of forming a speaker diaphragm, comprising:

providing a metal substrate having a selected thickness of at least 1 mil;

forming a speaker cone having a first side and a second side from the metal substrate; and thereafter anodizing the first and second sides of the speaker cone with a ceramic material to form a ceramic layer having a thickness of at least 1 mil on each of the first and second sides, where the metal substrate has a thickness that is not more than 86% of the total thickness of the ceramic layer on the first and second sides of the speaker cone and the metal substrate, and where the ceramic material is alumina.

17. The method of claim 16, where the metal substrate is aluminum.

18. The method of claim 16, where the metal substrate and each layer of the ceramic material are of substantially the same thickness.

19. The method of claim 16, where the step of forming the speaker cone further comprises stamping the speaker cone from the material substrate.

20. A speaker dome diaphragm, comprising a composite material of a predetermined thickness, where the composite material is formed of a metal substrate at least 1 mil thick between at least two layers of ceramic material at least 1 mil thick, and where the thickness of the metal substrate is no more than 86% of the thickness of the composite material, and where the ceramic material is alumina.

21. The speaker diaphragm dome of claim 20, where the metal substrate is aluminum.

22. The speaker diaphragm dome of claim 20, where the metal substrate and each layer of the ceramic material are of substantially the same thickness.

23. A speaker diaphragm dome, comprising a composite material of a predetermined thickness, where the composite material is formed of a metal substrate at least 1 mil thick between at least two layers of ceramic material at least 1 mil thick, and where the combined thickness of the ceramic material is at least 14% of the thickness of the composite material, and where the ceramic material is alumina.

24. The speaker diaphragm dome of claim 23, where the metal substrate is aluminum.

25. The speaker diaphragm dome of claim 23 where the metal substrate and each layer of the ceramic material are of approximately the same thickness.

26. A speaker diaphragm dome, comprising a composite material of a predetermined thickness, where the composite material is formed of a metal substrate at least 1 mil thick between at least two layers of ceramic material at least 1 mil thick, and where the thickness of the metal substrate is no more than 80% of the thickness of the composite material, and where the ceramic material is alumina.

27. The speaker diaphragm dome of claim 26, where the metal substrate is aluminum.

28. The speaker diaphragm dome of claim 26, where the metal substrate and each layer of the ceramic material are of substantially the same thickness.

29. A speaker diaphragm dome, comprising a composite material of a predetermine thickness, where the composite material is formed of a metal substrate at least 1 mil thick between at least two layers of ceramic at least 1 mil thick, and where the combined thickness of the ceramic material is at least 20% of the thickness of the composite material, and where the ceramic material is alumina.

30. The speaker diaphragm dome of claim 29, where the metal substrate is aluminum.

31. The speaker diaphragm dome of claim 29, where the metal substrate and each layer of the ceramic material are of approximately the same thickness.

32. A speaker diaphragm dome comprising:

a first ceramic layer of predetermined thickness at least 1 mil thick;

a second ceramic layer of a predetermined thickness at least 1 mil thick; and a metal substrate positioned between the first and second ceramic layers, the metal substrate having a thickness of at least 1 mil and that is not more than 86% of the total thickness of the first ceramic layer, the second ceramic layer and the metal substrate, and where the ceramic material is alumina.

33. The speaker diaphragm dome of claim 32, where the metal substrate is aluminum.

34. The speaker diaphragm dome of claim 32, where the metal substrate and each layer of the ceramic material are of substantially the same thickness.

35. A method of forming a speaker diaphragm, comprising:

providing a metal substrate having a selected thickness of at least 1 mil;

forming a speaker dome having a first side and a second side from the metal substrate; and thereafter anodizing the first and second sides of the speaker dome with a ceramic material to form a ceramic layer having a thickness of at least 1 mil on each of the first and second sides, where the combined thickness of the ceramic layers is at least 14% of the thickness of the total thickness of the ceramic layer on the first and second sides of the speaker diaphragm and the metal substrate, and where the ceramic material is alumina.

36. The method of claim 35, where the metal substrate is aluminum.

37. The method of claim 35, where the metal substrate and each layer of the ceramic material are of substantially the same thickness.

38. The method of claim 35, where the step of forming the speaker dome further comprises stamping the speaker dome from the material substrate.

* * * * *